United States Patent [19]

Jansen

[11] Patent Number: 4,646,209

[45] Date of Patent: Feb. 24, 1987

[54] ILLUMINATED STANDING SUPPORT FOR PLANT AND FLOWER BOXES AND OTHER RECIPIENTS

[76] Inventor: Paul Jansen, Otterstraat 95, 2300 Turnhout, Belgium

[21] Appl. No.: 720,603

[22] Filed: Apr. 5, 1985

[30] Foreign Application Priority Data

Apr. 9, 1984 [BE] Belgium ..... 2/60389

[51] Int. Cl.[4] ..... F21P 1/02

[52] U.S. Cl. ..... 362/122; 362/417; 362/805

[58] Field of Search ..... 248/146, 318, 176, 339; 362/805, 806, 122, 123, 396, 223, 311, 358, 154, 417, 96, 101, 253; 211/119; 47/41.11

[56] References Cited

U.S. PATENT DOCUMENTS

| | | | |
|---|---|---|---|
| 395,845 | 1/1889 | Miller | 248/339 |
| 1,215,986 | 2/1917 | Pohlman | 362/101 |
| 1,217,655 | 2/1917 | Stanton | 248/524 |
| 2,030,249 | 2/1936 | Goldberg | 47/41.11 |
| 2,723,341 | 11/1955 | Greenspan | 362/122 |
| 3,005,192 | 10/1961 | Wyant | 362/154 |
| 3,513,585 | 5/1970 | Ross | 362/101 |
| 4,084,779 | 4/1978 | Moineau | 211/119 |
| 4,349,864 | 9/1982 | Smith | 362/805 |

FOREIGN PATENT DOCUMENTS

| | | | |
|---|---|---|---|
| 892522 | 3/1982 | Belgium . | |
| 33408 | 10/1964 | German Democratic Rep. | 362/122 |
| 14719 | of 1894 | United Kingdom | 47/41.11 |

*Primary Examiner*—J. Franklin Foss
*Assistant Examiner*—Robert A. Olson
*Attorney, Agent, or Firm*—Berman, Aisenberg & Platt

[57] ABSTRACT

The support comprises a support in a translucent material, a plant, flower or other recipient provided in the upper part of said support, a holder borne by the translucent support, a fitting with light source installed on said holder and in the center line of said translucent support for the illumination from within of said translucent support, and a lead with plug attached to said fitting.

9 Claims, 2 Drawing Figures

ILLUMINATED STANDING SUPPORT FOR PLANT AND FLOWER BOXES AND OTHER RECIPIENTS

The invention is for an improvement to an internally illuminated standing support for holding recipients filled with flowers, plants or other things, and consisting principally of a standing support of translucent but not transparent material, a plant, flower or other recipient with in the upper part of the said support a fixed or removable fitting with a light source installed on the centre line of the said support for the illumination from within of the transparent support and a lead with plug connected to the said fitting.

An illuminated support with removable recipient has been described in the Belgian Pat. No. 892522 of applicant. Here, however, a relatively wide hook-shaped holder of transparent material is attached to the bottom of the removable recipient, and the fitting with the light source installed in the centre line of the support is mounted in this holder. A spiral lead with plug is attached to the fitting, and this lead runs through an opening in the bottom of the support to the outside allowing the recipient to be lifted out of the support with the holder attached to it.

It has been observed that even though the holder is made of a transparent material the holder casts a shadow on the outer wall of the translucent support spoiling the aesthetic appearance of the illuminated support. Another disadvantage is that when the recipient and the attached holder is removed from the support and perhaps set down on the ground, the holder may break if the contents of the recipient are too heavy. The size of the recipient is thus limited.

In order to eliminate these disadvantages and at the same time allow the replacement of this lead by an ordinary low-cost straight lead and plug, the fitting with the light source is according to the principal characteristic of the invention mounted on a holder borne by the translucent support and is no longer mounted on the bottom of the removable recipient in which, for example, plants or flowers are contained.

According to another important characteristic of the invention very good results can be achieved with a bracket-shaped element the upper ends of which are suspended in the upper part of the translucent support and the lowest part of the bracket-shaped holder bears the fitting for the light source in the centre line of the support.

By way of example, but without being in anyway limitative, a description is given below of a selected embodiment of the illuminated standing support in accordance with the invention. This description refers to the attached drawings where:

Figure 1:
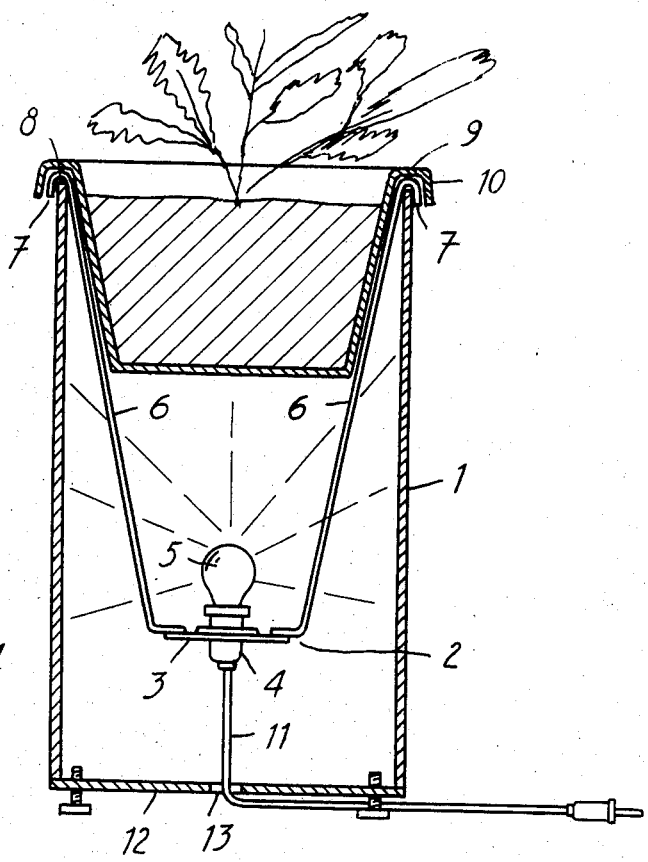
FIG. 1 shows a cross-section of an illuminated support with a removable holder on which the fitting with the light source is mounted.

In FIG. 1 can be seen the support 1, which can have any form whatsoever and which can be made of any translucent but not transparent material whatsoever, such as polyvinylchloride or methylmethacrylate. In this support 1 a holder 2 is suspended which consists of a ring 3 installed in the centre line of the support 1 and in which a fitting 4 with a lamp 5 is placed. Four rising wires 6 divided into two diametrically opposed pairs are attached to ring 3 and the upper ends of these wires finish in a hook 7, which hooks are hooked over the upper edge 8 and in the corners of the support 1 with for example a square cross-section, so that holder 2 can be lifted out of support 1. The use of thin metal wires 6 prevents shadows showing up on the walls of support. As holder 2 is not attached to the bottom of recipient 9 in which for example a plant is held and the folded edge 10 of which also hooks over the upper edge 8 of the support 1, recipient 9 can be of a larger size than was formerly the case. Indeed now there is no longer a danger that the holder 2 can be broken by the excessive weight of the recipient 9 when placed on the ground. Use can now also be made of a simple straight lead 11 with a plug, as when the recipient 9 is removed from the support 1, fitting 4 is no longer moved in the support 1. The lead 11 runs through an opening 13 provided in the bottom 12 of the support 1.

Figure 2:
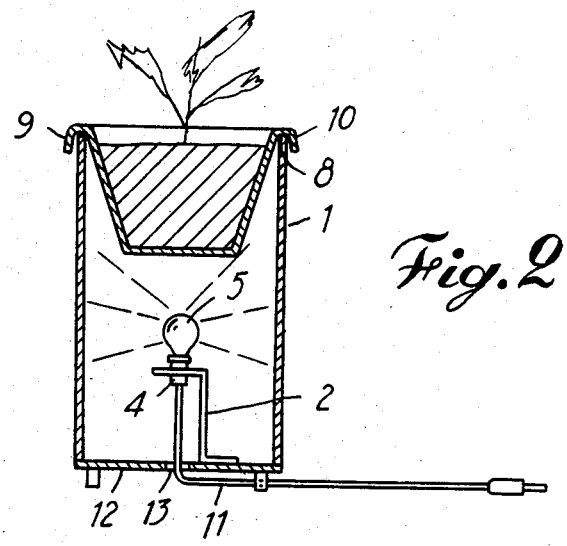
FIG. 2 shows a cross-section of a second possible embodiment of the support with a fixed holder on which the fitting with the light source is mounted.

In FIG. 2 one can see a smaller structure as described above but here a simple holder 2 is attached to the bottom 12 of the support 1, in which holder 2 fitting 4 with the lamp 5 is installed in the centre line of the support 1.

It goes without saying that the shape and dimensions of holder 2 can vary and that this can also be suspended or attached in whatsoever way in the support 1.

I claim:

1. An illuminated stand comprising:

a stand of translucent material having an upper edge, a holder supported by the stand, comprising a plurality of wires, each wire having a hooked upper end for engaging over the upper edge of the stand, and a lower end comprising, together with the lower ends of others of the wires, a support for a fitting, a fitting for a lamp secured to the holder, and a lamp installed in the fitting, the lamp being positioned on a central axis of the stand.

2. An illuminated stand of claim 1 in which the fitting is installed in a ring, and the plurality of wires comprises four metal wires each attached at its lower end in two diametrically opposed pairs to the ring, said metal wires each ending in a hook at its upper end for engaging over the upper edge of the stand.

3. An illuminated stand of claim 2 further comprising a lead, attached at its one end to the fitting, and having a plug for installation at a source of electric current at its other end, the lead being a straight lead which is movable through an opening in the stand.

4. An illuminated stand comprising:

a stand of translucent material having an upper edge, a holder supported by the stand, a fitting for a lamp secured to the holder, and a lamp installed in the fitting, the lamp being positioned on a central axis of the stand, and a pot for plants or flowers supported by the upper edge of the stand, said pot being positioned above the level of the lamp;

the holder comprising a plurality of wires, each wire having a hooked upper end for engaging over the upper edge of the translucent stand, and a lower end comprising, together with the lower ends of others of the wires, a support for the fitting, the fitting being situated on a central axis of the plant stand, the lamp being installed in the fitting for illumination of the translucent plant stand from within, and the fitting being attached at one end of a lead which has, at its other end, a plug for installation at a source of electric current.

5. An illuminated stand of claim 4 in which the fitting is installed in a ring and the plurality of wires comprises four metal wires each attached at its lower end, in two diametrically opposed pairs, to said ring, said metal wires each ending in a hook at its upper end for engaging over the upper edge of the stand.

6. An illuminated stand of claim 4, wherein said lead is a straight lead which is movable through an opening in the stand.

7. An illuminated stand with a plant or flower pot, comprising in combination:

a stand of translucent material having an upper edge and a central axis, a holder comprising a plurality of wires, each wire having a hooked upper end for engaging over the upper edge of the stand and a lower end comprising, together with the lower ends of other wires, a support for a fitting, a fitting for a lamp secured to the support of the holder on the central axis of the stand, a lamp installed in the fitting for illumination of the translucent stand from within, a lead having two ends, one of which is attached to the fitting, and the other of which has a plug for installation at a source of electric current, and a pot for plants or flowers supported by the upper edge of the stand, said pot being positioned in the stand above the level of the lamp.

8. An illuminated stand of claim 7 in which the fitting is installed in a ring and the plurality of wires comprises four metal wires each attached at its lower end in two diametrically opposed pairs to the ring, each of said metal wires ending in a hook at its upper end for engaging over the upper edge of the stand.

9. An illuminated stand of claim 7 in which the lead is a straight lead which is movable through an opening in the stand.

* * * * *